US006776686B2

(12) United States Patent
Todokoro

(10) Patent No.: US 6,776,686 B2
(45) Date of Patent: Aug. 17, 2004

(54) CONTROLLABLE CAR WITH RUNWAY FOR CHARGING CAR AND DISPLAYING STATE OF CHARGE

(75) Inventor: Masatoshi Todokoro, Matsudo (JP)

(73) Assignee: Staff Co., Ltd., Tokyo (JP)

( * ) Notice: Subject to any disclaimer, the term of this patent is extended or adjusted under 35 U.S.C. 154(b) by 0 days.

(21) Appl. No.: 10/226,358

(22) Filed: Aug. 23, 2002

(65) Prior Publication Data

US 2003/0153242 A1 Aug. 14, 2003

(30) Foreign Application Priority Data

Feb. 12, 2002 (JP) ..... 2002-034131

(51) Int. Cl.[7] ..... A63H 30/00
(52) U.S. Cl. ..... 446/454; 463/58
(58) Field of Search ..... 446/431, 454–456, 446/462, 468; 463/58–63

(56) References Cited

U.S. PATENT DOCUMENTS 3,712,615 A * 1/1973 Staats et al. ..... 463/59
3,970,309 A * 7/1976 Sato ..... 463/59
4,163,341 A * 8/1979 Jones et al. ..... 446/138
4,816,795 A * 3/1989 Suto ..... 335/272
4,854,909 A * 8/1989 Ishimoto ..... 446/129
5,767,655 A * 6/1998 Ostendorff et al. ..... 320/107
5,851,134 A * 12/1998 Chiu ..... 446/468
5,970,882 A * 10/1999 Smith et al. ..... 104/60
5,974,977 A * 11/1999 Johnson et al. ..... 104/60
6,171,171 B1 * 1/2001 Barthold ..... 446/438
6,343,972 B1 * 2/2002 Ogawa et al. ..... 446/444
6,586,942 B2 * 7/2003 Lam ..... 324/426

* cited by examiner

*Primary Examiner*—John M. Hotaling, II
(74) *Attorney, Agent, or Firm*—Swidler Berlin Shereff Friedman, LLP

(57) ABSTRACT

The object is to provide a running toy which can be charged while the player plays with the toy by simplifying operation of charging the running toy and by providing a charging runway as one element of playing with the running toy. The present invention relates to a running toy comprising a running body and a runway, wherein said running body comprises a reception means for receiving outer operating information, a control means for control based on the information received by the reception means, a driving means for making wheels rotate by control signals from the control means, a condenser able to supply electric power to the driving means, and a connecting means connected to the condenser and charging the condenser from the outside of the running body, and wherein said runway comprises a power supply for supplying electric power and an electric power supply means connected with said power supply and adapted to come in contact with a connecting means of said running body and to supply electric power.

5 Claims, 6 Drawing Sheets

(A)

(B)

(C)

CONTROLLABLE CAR WITH RUNWAY FOR CHARGING CAR AND DISPLAYING STATE OF CHARGE

BACKGROUND OF THE INVENTION

1. Field of the Invention

The present invention relates to a running toy and a runway.

2. Description of the Related Art

Conventionally, running toys adapted to run on electric power batteries as power sources are costly because primary batteries are used and the usual batteries must be frequently replaced with new ones. Moreover, there are rechargeable running toys adapted to use rechargeable batteries of secondary batteries, however, such running toys are adapted to use nickel-cadmium (NiCd) batteries as secondary batteries, so each of which disadvantageously has a low voltage and a small discharge current, and to secure long discharging duration and high speed, large-capacity nickel-cadmium batteries or a plurality of nickel-cadmium batteries have to be used, which disadvantageously makes running toys heavy and large-sized, and which require long charging times.

Under such background, running toys adapted to use condensers as power sources have been sold recently. By using condensers as power sources, running toys become capable to be charged for a very short time and to output a comparatively high voltage, and, condensers in themselves are small-sized, which advantageously makes running toys small-sized. Moreover, condensers in themselves are low-priced, which makes running toys low-priced.

However, this type of condensers have small capacity, and running toys have running times for only a few minutes even if the condenser is fully charged. Therefore, running toys have to be charged every several minutes and have been unsuitable for racing cars by necessity of frequent charge.

Therefore, the present invention has been made in view of circumstances of the aforesaid problems inherent in prior art, and it is an object of the present invention to provide a running toy which can be charged while the player plays with the toy by simplifying operation of charging the running toy and by providing a charging runway as one element of playing with the running toys.

SUMMARY OF THE INVENTION

According to a first aspect of the present invention, there is provided a running toy comprising a running body and a runway, wherein said running body comprises a reception means for receiving outer operating information, a control means for control based on the information received by the reception means, a driving means for making wheels rotate by control signals from the control means, a condenser able to supply electric power to the driving means, and a connecting means connected to the condenser and charging the condenser from the outside of the running body, and wherein said runway comprises a power supply for supplying electric power and an electric power supply means connected to said power supply and adapted to come in contact with the connecting means of said running body so as to supply electric power.

According to the construction of the first aspect of the present invention, the player can charge the running toy while playing by simplifying operation of charging the running toy and by providing a charging runway as one element of playing with the running toy.

According to a second aspect of the present invention, there is provided a running toy as set forth in the first aspect of the invention, wherein the runway is provided with a display means for displaying a state of charging the running body.

According to the construction of the second aspect of the present invention, by providing the display means, the runway can display a remaining quantity and a state of power supply capacity of the runway, and when connecting terminals of the runway are in contact with electric power supply rails, a remaining quantity of power supply capacity of the condenser, a state of charge and duration until completion of charge.

According to a third aspect of the present invention, there is provided a running toy as set forth in the first or second aspects of the invention, wherein the electric power supply means of the runway is a pair of metal pieces disposed at the side of the runway.

According to the construction of the third aspect of the present invention, by providing the electric power supply means of the runway at the side of the runway, electric power can be normally supplied even if a height of the running body changes.

According to a fourth aspect of the present invention, there is provided a running toy as set forth in any of the first to third aspects of the invention, wherein the runway is constructed such that an entranceway thereof is widened in the shape of a fan so as to guide said running body easily from the entranceway into the runway.

According to the construction of the fourth aspect of the present invention, the runway can easily guide the running toy into the runway by widening one end thereof in the shape of a fan.

According to a fifth aspect of the present invention, there is provided a running toy as set forth in any of the first to fourth aspects of the invention, wherein said running body is adapted to be provided with the display means for displaying a storage state of the condenser so as to get information such as a remaining quantity of electric power, whereby charging the running body can be well timed.

According to the construction of the fifth aspect of the present invention, the remaining quantity of power supply capacity of the condenser, the state of charge, the duration until completion of charge, and time allowable to run can be displayed on the display means of the running body.

According to a sixth aspect of the present invention, there is provided a running toy as set forth in any of the first to fifth aspects of the invention, wherein the connecting means of said running body is a pair of connecting terminals disposed at the side of the running body.

According to the construction of the sixth aspect of the present invention, by providing the connecting terminals of the running body at the side, electric power can be normally supplied even if a height of the running body changes.

According to a seventh aspect of the present invention, there is provided a running toy as set forth in any of the first to sixth aspects of the invention, wherein the connecting terminals of said running body have elastic force.

According to the construction of the seventh aspect of the present invention, an effect is made on equalizing a gap between the running body and the runway during charge, and the connecting terminals are welded to the electric power supply means with pressure, whereby electric power can be normally supplied.

According to an eighth aspect of the present invention, there is provided a running toy as set forth in any of the first to seventh aspects of the invention, wherein a steering mechanism for controlling traveling direction is provided on front wheels of said running body.

According to the construction of the eighth aspect of the present invention, by providing the steering mechanism, the running toy can run with turning in a lateral direction.

According to a ninth aspect of the present invention, there is provided a running toy as set forth in any of the first to eighth aspects of the invention, wherein the steering mechanism is adapted to have a parallel link structure with a link member and a crank member relative to a chassis, and the traveling direction of the running body can be controlled by sliding the link member in a lateral direction under the influence of an electromagnet fixed to the chassis.

According to the construction of the ninth aspect of the present invention, the steering mechanism of the running body can control the traveling direction of the running body.

There is provided a running toy comprising a running body and a runway, wherein said running body comprises a reception means for receiving outer operating information, a control means for control based on the information received by the reception means, a driving means for making wheels rotate by control signals from the control means, a condenser able to supply electric power to the driving means, and a connecting means connected to the condenser and charging the condenser from the outside of the running body, and wherein said runway comprises a power supply for supplying electric power and an electric power supply means connected to said power supply and adapted to come in contact with the connecting means of said running body so as to supply electric power, said runway comprising a display means for displaying the state of charge to the running body and said electric power supply means of the runway, wherein said electric power supply means of the runway comprises a pair of metal pieces disposed at the side of the runway, and said runway constructed so as to widen an entranceway thereof in the shape of a fan. And, the connecting means of said running body is a pair of connecting terminals disposed at the side of the running body, a steering mechanism to control the traveling direction is provided on front wheels of said running body, and the steering mechanism has a parallel link structure of a link member with a crank member related to the chassis.

DETAILED DESCRIPTION OF THE PREFERRED EMBODIMENT

Figure 1:
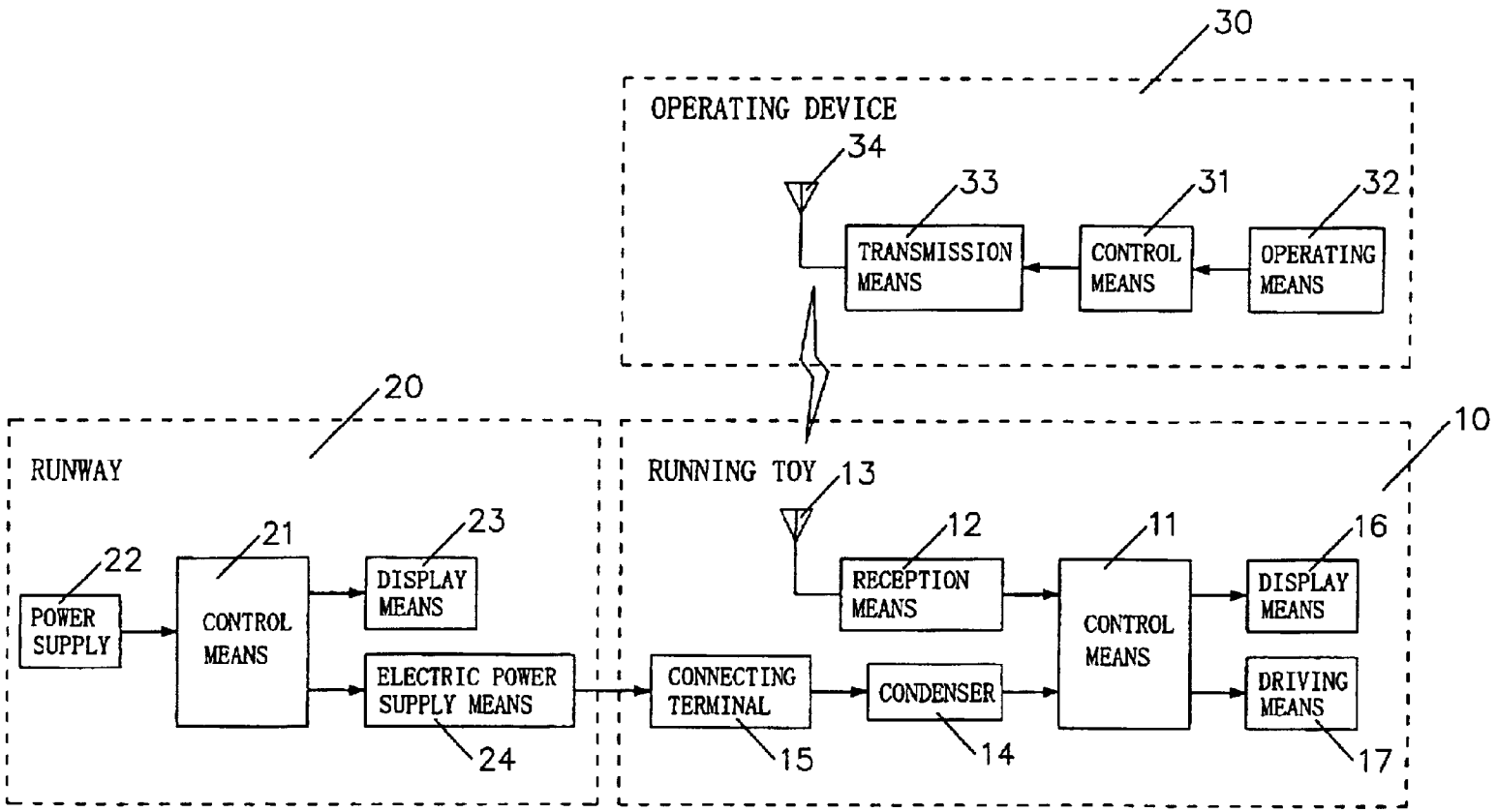
FIG. 1 is a block diagram showing an embodiment according to the present invention.

Referring to the attached drawings, embodiments of the present invention will be described below. FIG. 1 is a block diagram showing an embodiment of the present invention. FIG. 1 will be described. The present invention, roughly divided, consists of a running toy 10, a runway 20, and an operating device 30.

The running toy 10 consists of a control means 11, a reception means 12, an antenna 13, a condenser 14, connecting terminals 15, a display means 16, and a driving means 17. The running toy 10 receives electric waves sent from the operating device 30 through the antenna 13 at the reception means 12. The operating information so received is sent to the control means 11. Moreover, the control means 11 is designed to make a driving means 17 drive based on the received information. In addition, a power supply of the running toy 10 is supplied from the condenser 14. Furthermore, the remaining quantity of power supply capacity of the condenser 14 and the state thereof are monitored at the control means 11, and based on the information, the state of the condenser is adapted to be displayed at the display means 16.

The driving means 17 allows wheels of the running toy to rotate and change rotating speed and direction of the wheels. And, to change the traveling direction of the running toy 10, an operation of changing the direction of front wheels is performed. Moreover, the condenser 14 is adapted to be provided with the connecting terminals 15, which are allowed to connect with the outside of the running body 10, and when the connecting terminals 15 are connected with something to act as a charging device the condenser 14 is adapted to be charged.

The display means 16 is adapted to display the remaining quantity of power supply capacity of the condenser 14, the state of charge, the duration until completion of charge, the time allowable to run and the like. As a specific method for display, characters or drawings may be displayed by display of liquid crystal, dot matrix and the like, and by using light-emitting diode, changing light-emitting color, flashing speed, lighting, and turning off the light may be used for display.

The condenser 14 is an electric double-layer condenser and a very small-sized battery element. Desirably, the electric double-layer condenser is used which has a short charging time, depending on kinds of electric double layer condensers, a large capacity and a high discharge voltage corresponding to the charge voltage. In addition, by using with a conventional nickel-cadmium battery about 1.2 V per battery can be obtained, however, by using a condenser same as in the present embodiments about 2.5 V, which is higher than the double of the former voltage, can be obtained. In addition, this electric double-layer condenser has no polarity in principle and it is unnecessary to take into account the polarity of the charging voltage, therefore, when the polarity of charging voltage is reversed, the polarity of the output voltage is also reversed. When charged reversely, the running toy, which is normally supposed to run forward, however, runs reversely, so it is necessary to take care when it is charged. In the present embodiment, the runway 20 has the specific shape which is designed to allow the running toy to advance easily only from one direction into the runway so as to prevent the polarities being reversed when the toy is charged.

The runway 20 consists of a control means 21, a power supply 22, a display means 23, and electric power supply rails 24. The runway 20 is supplied by the power supply 22. The electric power supply rails 24 are terminals adapted to connect with the connecting terminals 15 of the running toy 10 and provided in the form of rail. The control means 21 is adapted to control a quantity of power supply to be charged to the electric power supply rail and to control the display means. The display means 23 is adapted to display the remaining quantity and the state of power supply capacity of power supply 22, in addition, when the connecting terminals 15 of the running toy 10 are in contact with the electric power supply rails 24, the remaining quantity of power supply capacity of the condenser 14, the state of charge and the duration until completion of charge.

In addition, the power supply 22 used for the runway 20 may be a battery such as primary batteries (manganese battery, alkali battery, button-type buttery, and lithium battery), secondary batteries (nickel-cadmium battery, nickel-hydrogen battery, lithium-ion battery, and lead-acid battery), fuel battery, and solar battery, and furthermore, alternating-current power supply and direct-current power supply may be used.

The operation device 30 consists of a control means 31, an operating means 32, a transmission means 33, and an antenna 34. Operating information from the operation means 32 is sent to the control means 31 adapted to control the transmission means 33 and send the operating information from the operating means 32 by electric waves through the transmission means 33 and the antenna 34. The running toy is adapted to run based on this operating information. For the electric waves sent from the operating means 30, a frequency band of 27 MHz or 40 MHz is desirably used. Furthermore, any of AM (amplitude modulation type), FM (frequency modulation type), and PCM (digital) may be used as the modulation system. Although the embodiment is not shown, the operating device 30 may be a transmitter commercially available.

Figure 2:
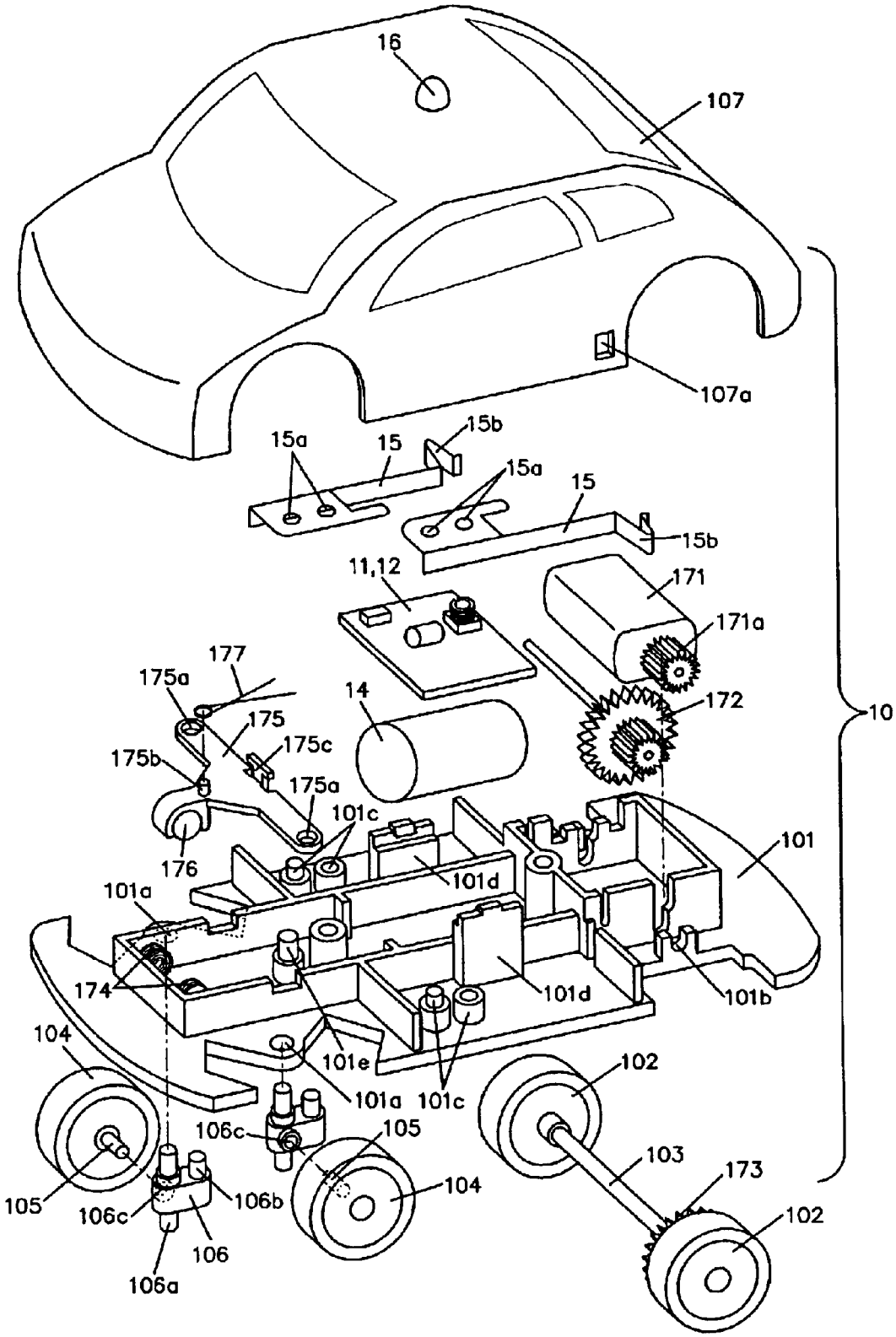
FIG. 2 is an exploded perspective view of a running toy according to the present invention.
Figure 3:
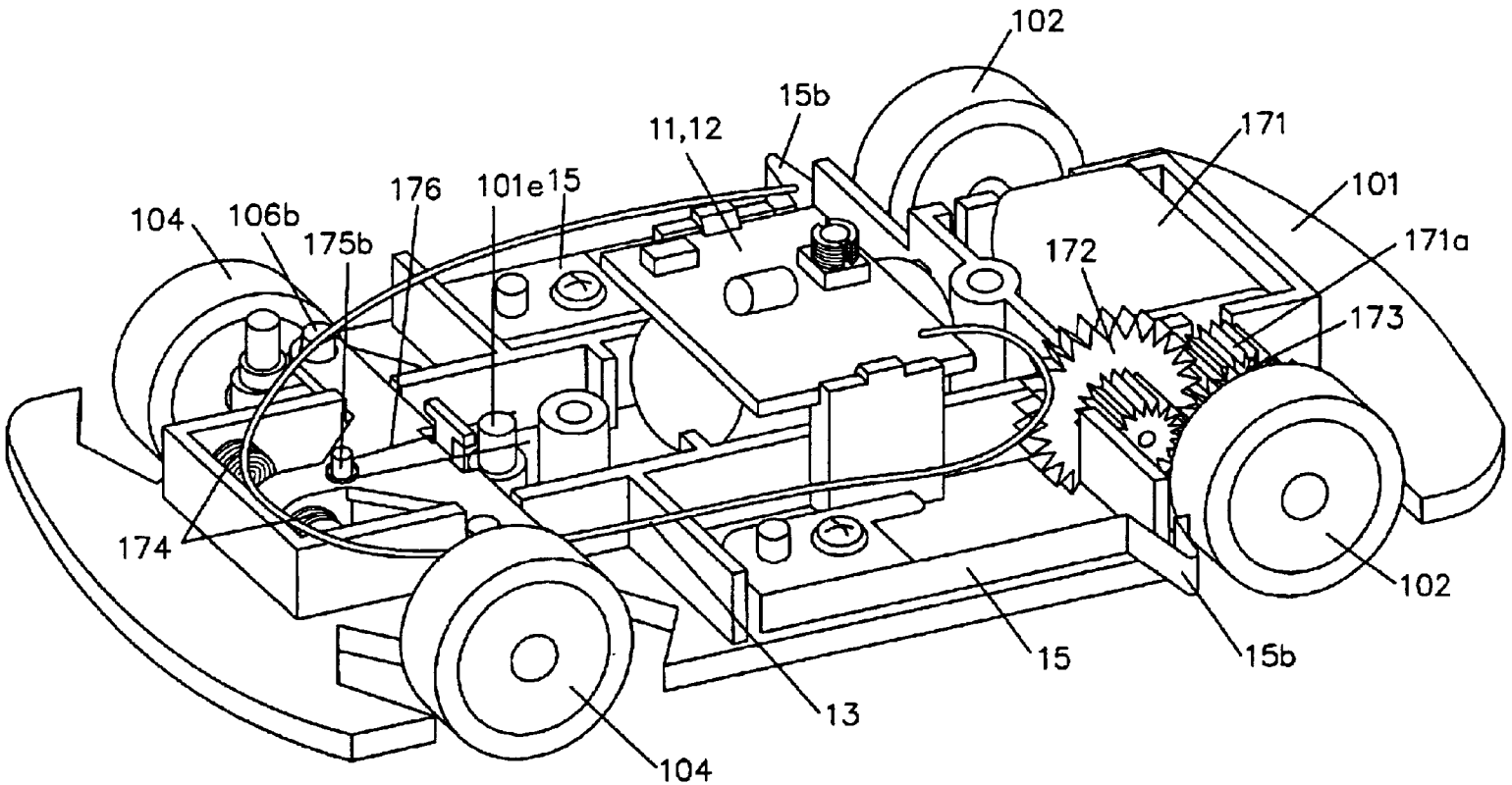
FIG. 3 is a perspective view showing the construction of the running body according to the present invention.

Referring to FIGS. 2 and 3, the running toy will be described below. Front wheel bearings 101*a* are provided in front of a chassis 101 in a longitudinal direction and an axle 106*a* of a crank 106 is supported thereby in such a manner as to rotate freely. And, one end of front wheel axles 105 are rotatably attached to bearings 106*c* provided on the crank 106. In addition, front wheels 104 are rotatably attached to the other end of the front wheel axles 105. Moreover, an axle 106*b* provided on the crank 106 is rotatably provided to crank bearing holes 175*a* provided on a link 175, and by the action of parallel link of the crank 106 and the link 175, the front wheels 104 rotatably supported by each front wheel axle 105 are adapted to be constantly parallel.

And, magnetic material 176 is provided on the central part of the link 175. In addition, a torsion spring 177 is fitted loosely to a projection 175*b* provided on upper surface of the link. Moreover, the torsion spring 177 is adapted to weld a spring stop 175*c* and a spring bearing 101*e* with pressure at the both ends thereof. And furthermore, electromagnets 174 are disposed at both sides of the magnet material 176 so as to be close to the magnet material 176 provided on the link 175.

Further, the condenser 14 is provided in the central part of the chassis 101, near the upper part thereof the control means 11 and the reception means 12 are provided, and the control means 11 and the reception means 12 are provided on a control base and fixed at base stops 101*d*. Said condenser 14 is also fixed on the base. In addition, as shown in FIG. 3, the antenna 13 is provided from the reception means 12 (base) so as to spread over the whole toy to increase the reception sensitivity. Moreover, with a hole at an optional position of a body cover 107, the antenna 13 may be out through the hole.

In addition, the connecting terminals 15 are terminals for impressing voltage on and charging said condenser 14, provided on both sides of the center of the chassis 101, and secured to connecting terminal stops 101*c* by screws. The connecting terminals 15, for which metal materials with high conductivity are used, are formed in the shape of plate spring for having elasticity so as to be welded with pressure to the electric power supply rails 24. Contact parts 15*b* are provided in U-shaped and the tops thereof are welded with pressure so as to be contact with the electric power supply rails 24, whereby the condenser 14 may be charged by conduction from the electric power supply rails 24.

In addition, a motor 171 is provided in the rear part of the chassis 101, and a pinion gear 171*a* is rotatably attached to a motor axle of the motor 171. Rotation by the motor 171 is transmitted to a gear 172 through the pinion gear. The gear 172 is a reduction gear which works to reduce rotational speed and increase rotational force of the motor 171. Furthermore, the rotational force from the gear 172 is transmitted to a gear 173. The gear 173 has rear wheels 102 rotatably attached to both ends of a rear wheel axle 103 mounted on rear wheel bearings 101*b* of the chassis 101, the rear wheels are provided in such a manner as to rotate freely, and rotation of the gear 173 rotatably attached to the rear wheel axle 103 allows the rear wheels 102 to rotate, whereby the running toy runs.

The body cover 107 is provided so as to cover the chassis 101 and connecting terminal holes 107*a* to connect the connecting terminal 15 with the outside are provided on the both sides of the body cover 107. The display means 16 is provided on the top of the body cover 107, and in the embodiment, light-emitting diode showing the state of the running toy is provided.

Figure 4:
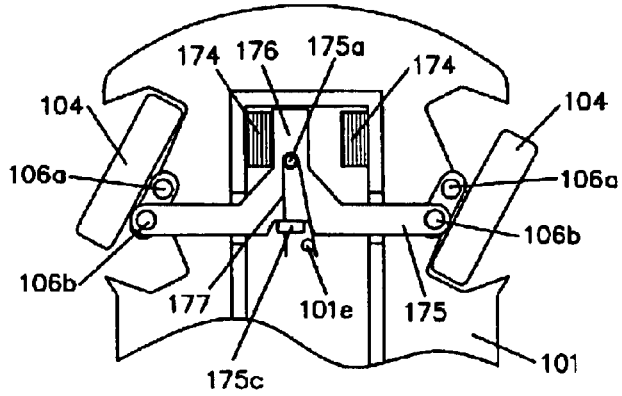
FIG. 4 is a diagram illustrating an operation of front wheels of the running toy according to the present invention.
Figure 4:
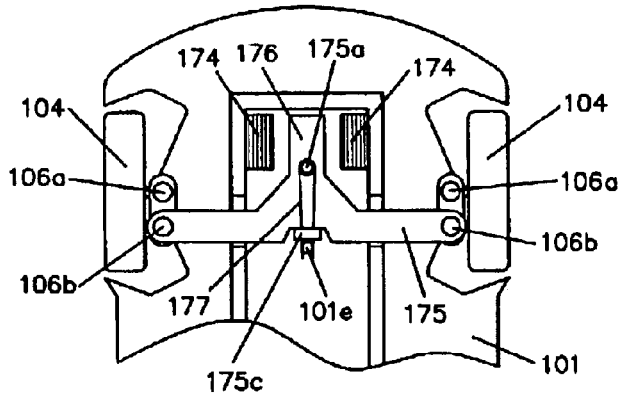
Figure 4:
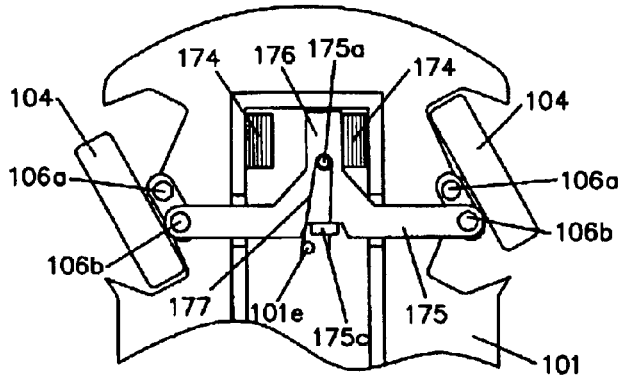

Referring to FIG. 4, drive of the front wheels part will be described below. (A) to (C) show a change of running states from rightward to leftward. The front wheels 104 have the parallel link structure of the body chassis 101, the crank 106 and the link 175, whereby the front wheels 104 are adapted to be in parallel to each other at all times. In addition, sliding the link 175 in the lateral direction allows the front wheels to change the direction, whereby the running toy change the running direction. The magnetic material 176 fixed to the link 175 is adapted to slide in the lateral direction in virtue of the magnet force which the electromagnets 174 wear by magnetization of the electromagnets 174 provided near the both sides thereof.

In short, magnetization of the right electromagnet 174 makes the front wheels 104 turn to the left, and magnetization of the left electromagnet 174 makes the front wheels 104 turn to the right. In addition, when magnetism of the electromagnet 174 is released, the force of the torsion spring fitted loosely to the projection 175*b* provided on upper surface of link 175 allows the front wheels to return to the straight direction of (B). Specifically, when the link 175 slides to either side, the spring bearing 101*e* provided on the chassis 101 and the spring stop 175*c* provided on the link allow the torsion spring 177 to open, whereby the spring torsion is adapted to make the wheels return to the straight direction by restoring force to restore the shape thereof to the original one.

Figure 5:
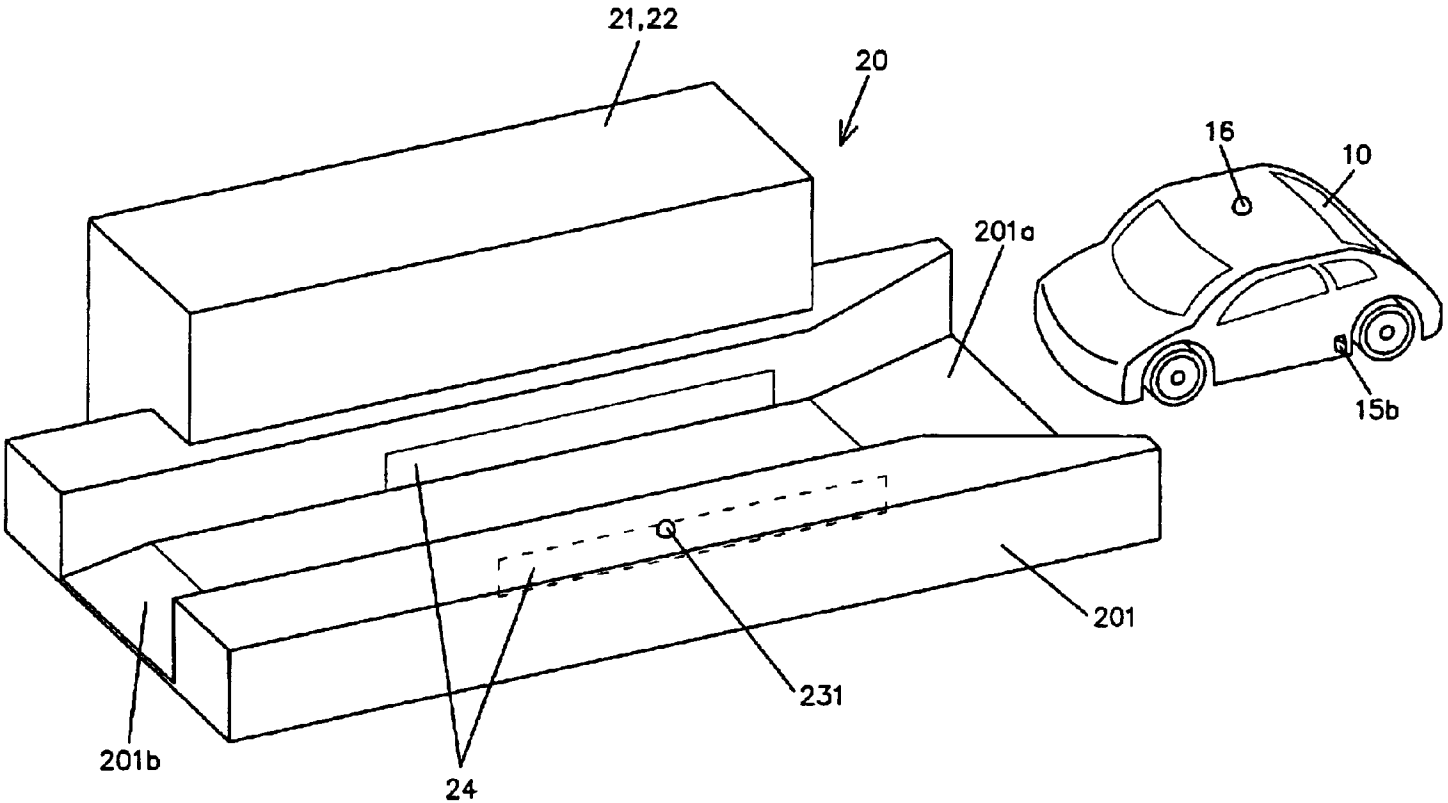
FIG. 5 is a diagram showing a runway according to the present invention.

Referring to FIG. 5, the runway 20 will be described below. A runway 201 of the runway 20 is provided a little wider than the width of the running toy 10. In the embodiment, it is provided to be about 1 mm wider than the width of the running toy and it is desirable to make this gap in the range of 0.5 mm to 2 mm. Although it is possible to carry out the invention over this range, the electric power supply rails 24 and the connecting terminals 15 may be unable to have more reliable contact. In addition, on the central part of the runway, the electric power supply rails 24 are installed in the shape of rail on the wall surface of a runway guide and adapted to charge electric power even if position of the running toy 10 deviates in any of vertical and horizontal directions. And, the electric power supply rails 24, for which the metal materials with high conductivity are used, can charge electric power to the running toy.

Figure 6:
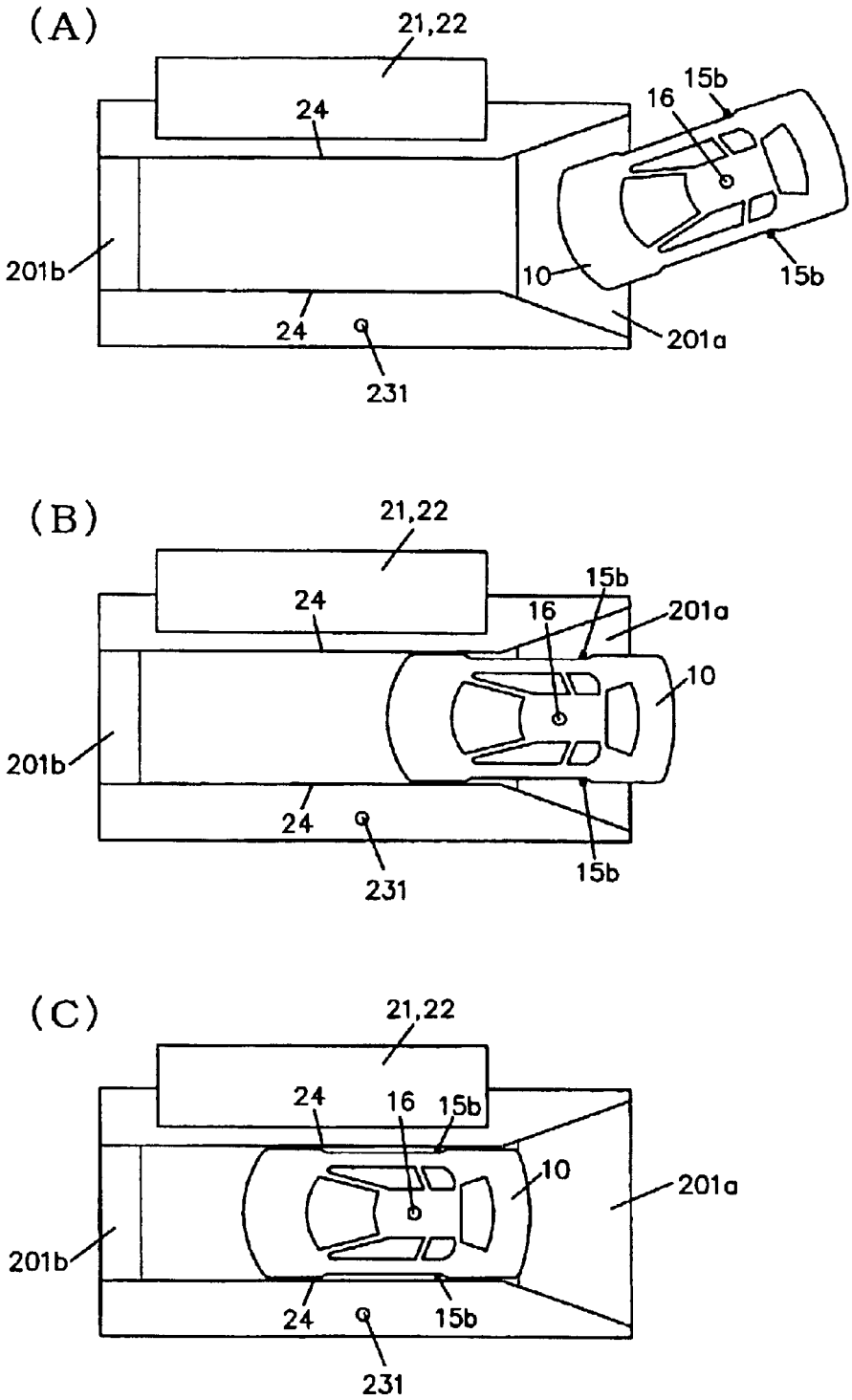
FIG. 6 is a diagram showing a state in which a correction to the direction of the running toy is being made according to the present invention.

Furthermore, an admission passage 201*a* is provided at one end of the runway 201 in such a manner to be wider than the normal width, guides as far as the runway on which the electric power supply rails are provided, and is formed in the shape of a fan. Thus, shown in FIG. 6, the direction of the running toy entering from a different angle from a direction of the runway as shown in (A) is corrected to the same direction as the runway as shown in (B) and the running toy is guided to the electric power supply rails 24 as shown in (C).

And, a retreat way 201*b* is provided on the other end of the runway 201 and desirably provided in such a manner to be same as or a little narrower than inside of the runway in width so as to prevent itself from being entered from the opposite direction. In addition, the display means 23 is provided on the runway 20, and in the embodiment, LED 231 is provided. By virtue of this LED, the remaining quantity and the state of power supply capacity of the power supply 22 may be displayed and when the connecting terminals 15 of the running toy 10 is in contact with the electric power supply rails 24, the remaining quantity of power supply capacity of the condenser 14, the state of charge and the duration until completion of charge may be displayed. Specifically, change in color of LED, flashing speed, lighting, and turning off the light are used for display.

Being constructed as has been described heretofore, the present invention can provide the wonderful toy which is adapted to simplify operation of charging the running toy, provide the charging runway as one element of playing with the running toy, and charge the running toy while the player play with the toys. In addition, while the present invention has been described with reference to the preferred embodiment, the invention is not limited to the embodiment so described but may be modified variously without departing from the technical range determined by the scope of claims that will follow this description of the modified embodiment.

In the embodiment, while the display means 16 and 23 both are adapted to display on display means, a sound output means may be provided so as to report the remaining quantity of power supply capacity of the condenser 14, the state of charge, the duration until completion of charge, the time allowable to run and the like by sound.

Furthermore, when the running toy 10 which runs in the runway 20 is supplied, the running toy 10 can be stopped suddenly by being supplied with the opposite polarity to voltage polarity of the normal supply. As this occurs, when electric capacity of the condenser becomes zero, the control means 21 of the running toy 20 is desirably provided to stop supplying electric power.

In addition, a belt-runway in ringed shape is provided parallel to the runway 20 so as to allow a plurality of running toys 10 to run in the runway side by side, and furthermore, an approach way to the runway 20 and a retreat way from the runway 20 are provided on a part of the belt-runway so as to guide the running toy 10 into the runway 20, charge the running toy in the runway 20, and then let the running toy 10 return to the belt-runway through the retreat way when a quantity of electric power decreases while the running toy 10 is running in the belt-runway and the like, whereby races may be hold by using a plurality of running toys 10 to run in the belt-runway. Moreover, as this occurs, the running toy and the runway are provided so that the player can enjoy tactics such as timing for charge among the players.

Furthermore, in the embodiment, the electric power supply rails 24 provided on the runway 20 are installed on the wall surface of the runway guide in the form of rail, however, installed position of the electric power supply rails may be provided on the running surface (the surface of runway) so as to supply electric power from the underside of the running toy 10, in addition, the electric power supply rails may be provided on the upper side of the runway by being constructed in such a manner as to cover the top of the runway 20, whereby electric power can be supplied the upper side of the running toy 20. As this occurs, the running toys 10 can be supplied by providing the connecting terminals 15 disposed at the positions correspondent to the positions of the electric power supply rails. And, in connection with the number of the disposed electric power supply rails, the rails may be disposed so as to be charged from two directions of the surface of runway and the surface of the wall at the same time or three directions of the upper side, the lower side, and the side. In this way, charge from a plural of directions allows the running toy 10 to be charged more surely.

Being implemented in the mode that has been described heretofore, the present invention provides the following advantages.

Simplifying operation of charging the running toy and providing the charging runway as one element of playing with the running toy allows the player to charge the running toy during play.

By providing the display means, the runway can display a remaining quantity and a state of power supply capacity of the runway, and when the connecting terminals of the running body are in contact with the electric power supply rails, the remaining quantity of power supply capacity of the condenser, the state of charge and the duration until completion of charge can be displayed.

With the electric power supply means of the runway at the side of the runway, electric power can be normally supplied even if the height of the running body changes.

By widening an end of the runway in the shape of a fan, the running toy may be easily guided into the runway.

The remaining quantity of power supply capacity of the condenser, the state of charge, the duration until completion of charge and the time allowable to run can be displayed on the display means of the running body.

By providing the connecting terminals of the running body at the side, electric power can be normally supplied even if the height of the running body changes.

With the effect of equalizing a gap between the running body and the runway and by welding the electric power supply means with pressure, the electric power can be normally supplied.

By providing the steering mechanism, the running toy can run with turning in the lateral direction.

The steering mechanism of the running body can control the traveling direction of the running body.

What is claimed is:

1. A running toy comprising a running body and a runway, wherein said running body comprises a reception means for receiving outer operating information, a control means for control based on the information received by the reception means, a driving means for making wheels rotate by control signals from the control means, a condenser able to supply electric power to the driving means, and a connecting means in the form of a pair of connecting terminals having elastic force disposed at the side of the running body connected to the condenser for charging the condenser from the outside of the running body, and wherein said runway comprises a power supply for supplying electric power and an electric power supply means in the form of a pair of metal pieces disposed at the side of the runway connected to the power supply and adapted to come in contact with the connecting means of said running body so as to supply electric power, and wherein said runway is provided with an electronic display means for displaying a state of charging said running body.

2. A running toy as set forth in claim 1, wherein said runway is constructed such that an entranceway thereof is widened in the shape of a fan so as to guide said running body easily from the entranceway into the runway.

3. A running toy as set forth in claim 1, wherein said running body is adapted to be provided with a display means for displaying a storage state of the condenser and get information such as a remaining quantity of electric power of the condenser, whereby charging the running body can be well timed.

4. A running toy as set forth in claim 1, wherein a steering mechanism for controlling traveling direction is provided on front wheels of said running body.

5. A running toy as set forth in claim 4, wherein the steering mechanism is adapted to have a parallel link structure with a link member and a crank member relative to a chassis, and the traveling direction of the running body can be controlled by sliding the link member in a lateral direction under the influence of an electromagnet fixed to the chassis.

* * * * *